United States Patent [19]

Terry et al.

[11] 4,244,272

[45] Jan. 13, 1981

[54] DISPERSION-CONTROLLED MULTIBARREL GUN SYSTEM

[75] Inventors: Edgar R. Terry, Richmond; Joseph A. Hudock, Shelburne, both of Vt.

[73] Assignee: General Electric Company, Burlington, Vt.

[21] Appl. No.: 949,607

[22] Filed: Oct. 10, 1978

[51] Int. Cl.[3] ..... F41D 7/04

[52] U.S. Cl. ..... 89/41 A

[58] Field of Search ..... 89/41 A, 41 SW, 41 SM

[56] References Cited

U.S. PATENT DOCUMENTS

| | | | |
|---|---|---|---|
| 1,353,267 | 9/1920 | Pierce | 89/41 A |
| 3,974,740 | 8/1976 | Billotet et al. | 89/41 SM |
| 4,124,849 | 11/1978 | Zahornasky et al. | 89/41 SW |

FOREIGN PATENT DOCUMENTS

| | | | |
|---|---|---|---|
| 372403 | 5/1932 | United Kingdom | 89/41 A |
| 705568 | 3/1948 | United Kingdom | 89/41 A |
| 1164107 | 9/1969 | United Kingdom | 89/126 |

*Primary Examiner*—Stephen C. Bentley

*Attorney, Agent, or Firm*—Bailin L. Kuch

[57] ABSTRACT

A system is provided for matching the auto- and cross-correlated components of error and constant and/or range-dependent biases with appropriate values of ballistic dispersion or random errors in order to decouple the gun system from the highly auto- and cross-correlated tracking and/or gun-order errors associated with high firing-rate multibarrel guns. This angular ballistic dispersion—artificially induced to some preset value or continuously adjusted during the tracking and/or firing interval—maximizes the probability of a preassigned number of hits on target. The system embodies (1) a logic for controlling the angular ballistic dispersion for the engagement conditions, (2) a control system which, using this logic, provides power to a mechanism which increases or decreases the gun angular dispersion in response to externally generated command signals, and (3) a mechanical dispersion control mechanism for positioning the individual barrels of the multibarrel gun system and thereby achieving the desired angular ballistic dispersion.

5 Claims, 5 Drawing Figures

DISPERSION-CONTROLLED MULTIBARREL GUN SYSTEM

BACKGROUND OF THE INVENTION

1. Field of the Invention

Artificially inducing ballistic dispersion into high firing-rate guns can be traced back to the period immediately following the American Civil War, at least insofar as the development of techniques and patented mechanisms for accomplishing such.

2. Prior Art

These efforts were directed solely to multibarrel gun applications, and are shown, for example in the following patents: U.S. Pat. No. 137,428, Farwell, Apr. 1, 1873; U.S. Pat. No. 145,563, Gatling, Dec. 16, 1873; U.S. Pat. No. 154,596, Farwell, Sept. 1, 1874; U.S. Pat. No. 173,751, Bailey, Feb. 22, 1876; U.S. Pat. No. 173,752, Bailey, Feb. 22, 1876; U.S. Pat. No. 179,450, Farrington, July 4, 1876; U.S. Pat. No. 182,729, Wilder, Sept. 26, 1876; U.S. Pat. No. 198,367, Farrington, Dec. 18, 1877; U.S. Pat. No. 211,737, Hotchkiss, Jan. 28, 1879; U.S. Pat. No. 211,849, Hotchkiss, Feb. 4, 1879; U.S. Pat. No. 218,190, Palmcrantz, Aug. 5, 1879; U.S. Pat. No. 220,545, Palmcrantz; Oct. 14, 1879; U.S. Pat. No. 298,493, Nordenfelt, May 13, 1884; U.S. Pat. No. 340,725, Nordenfelt, Apr. 27, 1886; U.S. Pat. No. 563,701, Wilder, July 7, 1896. An attendant logic for controlling these mechanisms in practice was not developed and field test data were not obtained to support the claims made. Emphasis was placed on the development of mechanisms for spreading or scattering shots traversely a prescribed distance apart. No attempt was made based on the expected engagement conditions to control the size, shape, and density of the ballistic pattern being built up at the target. These parameters inter alia collectively influence whether or not hits are obtained on target and, more importantly, that it is damaged to some acceptable state. While mechanisms patented since World War I, again for application to high firing-rate multibarrel guns, address the problem of increasing or decreasing the induced ballistic dispersion either to a preset value or continuously adjusted while firing, they again collectively and individually make no attempt to define a control logic for deploying the system effectively, and are shown, for example, in the following patents: U.S. Pat. No. 1,334,983, Arter, Mar. 30, 1920; U.S. Pat. No. 1,353,267, Pierce, Sept. 21, 1920; U.S. Pat. No. 1,448,587, Arntzen, Mar. 13, 1923; U.S. Pat. No. 1,551,809, Dodge, Sept. 1, 1925; U.K. Pat. No. 705,568, North et al, Mar. 17, 1954; U.S. Pat. No. 3,380,343, Chiabrandy and Tassie, Apr. 30, 1968; U.S. Pat. No. 3,897,714, Perrin, Tassie, and Smith, Aug. 5, 1975.

Supporting theoretical and essentially analytical investigations of the worth of induced dispersion for enhancing weapon system effectiveness were not to follow until the period between the two World Wars. These efforts were, for the most part, largely focused on pattern bombing, i.e., the deliberate spacing of free-fall bombs by prescribed spacing of aircraft in formation, salvo (scatter) bombing, or train (stick) bombing in order to insure that (1) the target is straddled by the bomb pattern released, and (2) the pattern density is such that no less than a specified number of bombs impact in the target area. It was not until the late 1930's and earlier 1940's that investigations of the worth of gunnery dispersion on its own merits were seriously undertaken here and abroad, and these have continued sporadically since World War II. These efforts too have been largely theoretical in nature and, thus, until now a viable dispersion-controlled gunnery system has remained essentially a will-of-the-wisp.

The basic problem facing these earlier investigators was their inability to satisfactorily map, measure, and describe analytically the gunnery process with the analytical tools and instrumentation then available. For high firing-rate guns, either with single or multiple barrels, the ballistic pattern is defined by a rapid and continuous sequence of projectiles directed at the target. The projectiles do not generally follow each other in exactly the same path, and, as a consequence, a dispersed pattern is built up at the target. The statistical characteristics of the resulting pattern generally involve three aspects. First, given target detection and assignment, there is the process involving certain random elements of bringing the gun to bear on target and keeping it on target during the engagement. From this process the requisite gun orders are generated. Because the errors in tracking are both auto-correlated and cross-correlated, so too are the gun orders generated. Superimposed on the tracking and gun-order generation process is the second aspect, viz., the ballistic dispersion. This process also involves several random elements, but in a different manner from the first aspect, since this random dispersion varies independently projectile to projectile, i.e., it is uncorrelated. Since this aspect is superimposed on the first, the tracking and gun-order auto-correlation and cross-correlation are induced on the sequentially ordered projectiles as they are fired. The third aspect arises because many of the engagement parameters—individual projectile hit probabilities, target vulnerability, auto- and cross-correlations, projectile time-of-flight, etc.—can and do change markedly during the firing interval. These essentially Lexian effects must be accounted for since they can change at a rate equal to the cyclic rate of fire of the gun. While these observations have all been confirmed by extensive field test programs conducted by both contractors and military and naval services here and abroad since World War II, no attempt has been made to develop a model for combining these separate but interrelated aspects of the gunnery process into a logical treatment of the whole.

SUMMARY OF THE INVENTION

By taking into account simultaneously the various aspects of the gunnery process, the engagement kinematics, and the target vulnerability, the present invention provides a means of control by which the effectiveness of high firing-rate multibarrel gun systems is increased in terms of target damage over those gun systems not employing this invention. The principal object of this invention is accomplished essentially by keeping a specified ballistic pattern size and density as measured at the target in some appropriate plane constant during the entire engagement. The specified size, shape, and density of this ballistic pattern is directly related to the auto- and cross-correlated components of the tracking and gun-order errors generated during the engagement and the target vulnerable area. These data can be readily obtained from field test measurements and terminal ballistic data handbooks. To keep the pattern size and density constant at the target during the engagement requires that the ballistic dispersion at the gun be increased or decreased continually as the engagement kinematics demand. Controlling the ballistic dispersion in this manner enhances essentially a pollination technique by ensuring that when a large number of projectiles is placed rapidly in the vicinity of the target, there will be a high probability that no less than a specified number of projectiles will strike the target vulnerable area.

BRIEF DESCRIPTION OF DRAWINGS

Other objects, advantages, and novel features of this invention will become apparent from the following detailed description of the invention when considered in conjunction with the accompanying drawings, in which.

DESCRIPTION OF THE INVENTION

Figure 1:
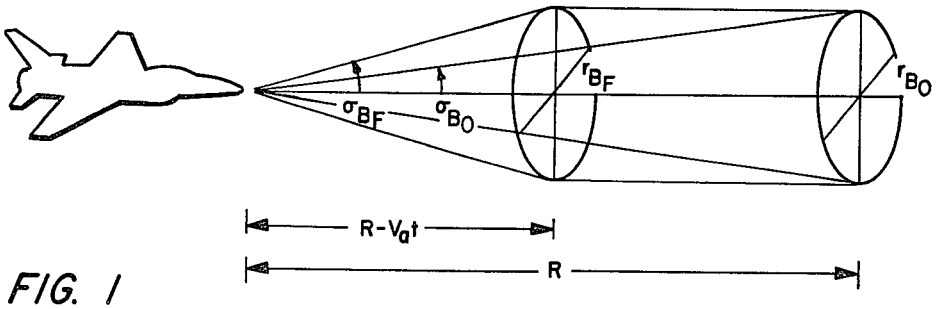
FIG. 1 is an illustration of the desired ballistic dispersion for air-to-ground gunnery as the aircraft approaches a target.

To facilitate an understanding of the preferred embodiment of the dispersion-controlled multibarrel gun system, it will be discussed as it would be employed in an air-to-ground role. Its application to air-to-air and air defense roles, requiring director-type gun fire control systems, will become readily apparent from the description to follow. The pilot display system currently used for air-to-ground gunnery is essentially a depressed reticle sight which projects the aiming dot or circle on a combining glass located above the instrument panel. Viewing the target through the combining glass the pilot is able to simultaneously see the pipper and the target. Prior to making his firing run on the target, the pilot depresses the pipper a specified amount which has been precalculated for the projectile's nominal trajectory. Such conditions are usually tabulated and available in handbook form. The pipper, thus, when superimposed upon the target, indicates the correct impact point only when the aircraft is at a precise preselected flight condition, e.g., aircraft gross weight at the instant of firing, load factor, slant range, etc. During the tracking and firing interval the pipper position relative to the target does not remain stationary, but continuously moves in a quasi-orbital path frequently referred to as the "aim wander path." This path can be adequately mapped, measured, and quantitatively described from gun cine camera film by finite-order stationary linear auto-regressive schemes from which the auto- and cross-correlation functions and aiming errors can be readily established.

In addition to the tracking errors generated while the aircraft closes with the target, other deleterious effects of certain aeroballistic phenomena are taking place, viz.: (1) ballistic pattern contraction due to (a) the straightforward vector combination of gun muzzle and aircraft velocities, and (b) the closing slant range between the gun and target during the engagement; (2) the projectile transport and associated effect on projectile arrival times at the target; (3) projectile muzzle velocity variation; (4) projectile lateral walk due to the harmonization scheme for multigun installations; and (5) projectile climb due to superelevation. The projectile transport phenomenon and muzzle velocity variation contribute essentially variability to the ballistic pattern density whereas projectile lateral walk and projectile climb induce range dependent biases into the tracking. These negative effects on the ballistic pattern being built up at the target during the firing interval, viz., the size, shape, and density of the ballistic pattern being built up at the target and its location relative to the target, can be blunted. This is readily accomplished by (1) specifying the desired pattern size and, hence, density, and shape required to cover the target and to damage the target at some specified level, and (2) keeping this pattern size and shape constant during the firing interval.

The specified size, shape, and density of the ballistic pattern is directly related to the auto- and cross-correlated components of the tracking error and range dependent biases generated during the engagement, and the target vulnerable area. These data can be readily obtained from field test measurements and terminal ballistic handbooks. To keep this pattern size and shape constant at the target during the firing interval requires adjustment of the angular dispersion at the gun. Investigations to date specify a circular-shaped pattern, although other shapes can be obtained. The control logic required to effect this condition at the target can be readily understood with reference to FIG. 1.

First define the following terms:

$\sigma_{BO}$=aeroballistically corrected inherent or initial specified angular ballistic dispersion in mils for the slant range at which tracking is initiated; by definition $$\sigma_{BO} = \sigma_B\left(\frac{V_m}{V_m + V_a}\right)$$

where $\sigma_B$ is the angular ballistic dispersion as obtained from test measurements, $V_m$ is the projectile muzzle velocity in feet per second, and $V_a$ is the aircraft velocity in feet per second.

$\sigma_{BF}$=final angular ballistic dispersion in mils for the slant range at which tracking ceases (aircraft pullup) required to maintain the specified pattern size at the target.

R=slant range in feet at which tracking is initiated.

t=tracking interval in seconds from initiation of track to aircraft pullup.

$r_{BO}$=inherent or initial specified ballistic pattern radius in feet measured at the target in the plane normal to the mean trajectory of the burst; $\sigma_{BO}$ and $r_{BO}$ are related by the expression $$r_{BO} = \frac{\sigma_{BO}R}{1000}$$

and $r_{BF}$=final ballistic pattern radius in feet at the target in the plane normal to the mean trajectory of the burst at the instant of aircraft pullup; $\sigma_{BF}$ and $r_{BF}$ are related by the expression:

$$r_{BF} = \frac{\sigma_{BF}(R - V_a t)}{1000}.$$

From FIG. 1, write $$\tan \sigma_{BO} = \frac{r_{BO}}{R} \quad (1)$$

and $$\tan \sigma_{BF} = \frac{r_{BF}}{R - V_a t}. \quad (2)$$

Since the objective is to keep the pattern area constant at the target during the engagement, write $r_{BO} \equiv r_{BF}$ so that combining Equations (1) and (2) yields $$(R - V_a t) \tan \sigma_{BF} = R \tan \sigma_{BO} \quad (3)$$

or $$\tan \sigma_{BF} = \frac{R \tan \sigma_{BO}}{R - V_a t}.$$

From small angle approximation theory, for $\alpha$ small, $\tan \alpha = \sin \alpha = \alpha$ and, accordingly, write for Equation (3)

$$\sigma_{BF} = \sigma_{BO}\left(\frac{R}{R - V_a t}\right). \quad (4)$$

From Equation (4), the required angular dispersion velocity can be obtained by differentiating $\sigma_{BF}$ with respect to t, viz., $$v = \frac{d\sigma_{BF}}{dt} = \sigma_{BO}\left(\frac{(R - V_a t)(O) - R(-V_a)}{(R - V_a t)^2}\right) = \frac{R V_a \sigma_{BO}}{(R - V_a t)^2}. \quad (5)$$

From Equation (5), the angular dispersion acceleration can be obtained by differentiating v again with respect to t, viz., $$a = \frac{dt}{dv} = \frac{d^2\sigma_{BF}}{dt^2} = \frac{(R - V_a t)^2(O) - (R V_a \sigma_{BO})(-2RV_a - 2V_a^2 t)}{(R - V_a t)^4} = \frac{2R^2 V_a^2 \sigma_{BO} - 2RV_a^3 \sigma_{BO} t}{(R - V_a t)^3} = \frac{2RV_a^2 \sigma_{BO}}{(R - V_a t)^3} \quad (6)$$

and, in general, write $$\frac{d^n \sigma_{BF}}{dt^n} = \frac{n!\, R V_a^n \sigma_{BO}}{(R - V_a t)^{n+1}}. \quad (7)$$

From Equations (4) through (6), it can be seen that $\sigma_{BF}$, v, and a are functions of the same variables, viz., the initial engagement conditions $\sigma_{BO}$, R, $V_a$, and t. For either fixed t and increasing $V_a$ or fixed $V_a$ and increasing t, as $V_a t$ approaches R in the respective denominators of these equations, $\sigma_{BF}$, v, a, and higher derivatives all approach infinity. This implies, of course, that as the aircraft and target close during the engagement, the angular ballistic dispersion increases nonlinearly, accelerating rapidly just before aircraft pullup. Thus, given that the underlying control logic of the present invention is to keep the ballistic pattern area constant and on target during the engagement, then for air-to-ground gunnery applications:

1. The required angular ballistic dispersion at the gun during any instant of the engagement is inversely proportional to the slant range at that instant and the factor of proportionality is the product of the specified initial angular ballistic dispersion and the slant range at the initiation of target tracking.
2. The instantaneous angular ballistic dispersion velocity is inversely proportional to the square of the slant range at that instant and the factor of proportionality is the product of the specified initial angular ballistic dispersion, the slant range at the initiation of target tracking, and the aircraft closing velocity.
3. The instantaneous angular ballistic dispersion acceleration is inversely proportional to the cube of the slant range at that instant and the factor of proportionality is the product of the specified initial angular ballistic dispersion, the slant range at the initiation of target tracking, and the square of the aircraft closing velocity.

Equation (4), to be sensitive to both the target vulnerability and target coverage, i.e., specifying the number of projectiles on target, is written in the form $$\sigma_B(t) = K\sigma_{BO}\left(\frac{R}{R - V_a t}\right) \quad (8)$$

for mechanization. Here K is a constant such that $0 < K \leqq 3$ for specifying the ballistic pattern at the target. From Equation (8) it can be seen that during the firing interval, the angular ballistic dispersion required for the $i^{th}$ round in the burst is $$\sigma_{Bi} = K\sigma_{BO}\left(\frac{R}{R - V_a[n + (i - 1)Y]}\right)$$

where $\eta$ is the time interval between initiation of the angular dispersion growth and the firing of the first round in the burst and $\tau$ is the riciprocal of the gun cyclic rate of fire in shots per second.

Figure 2:
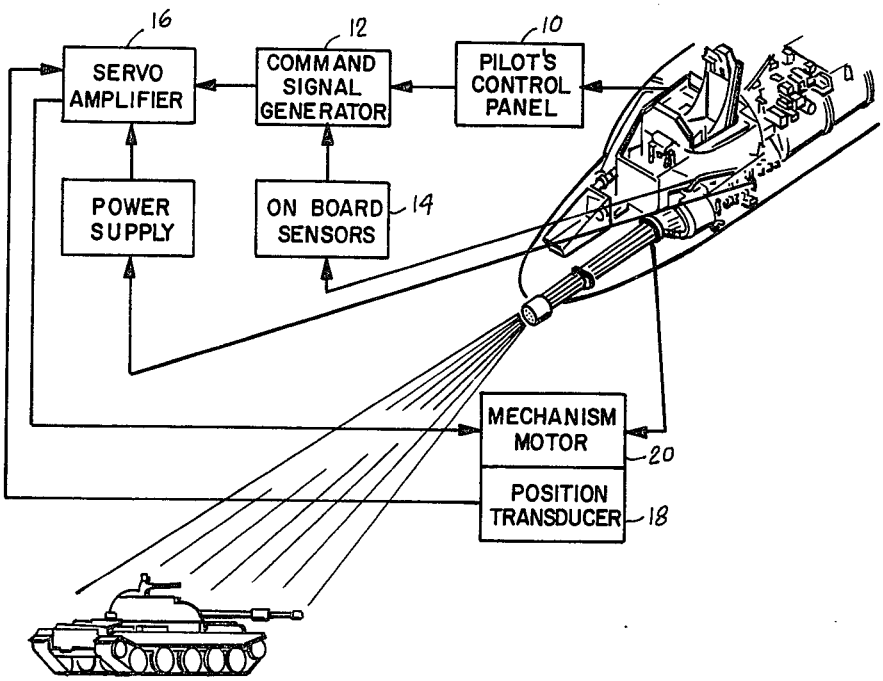
FIG. 2 is a block diagram of a system embodying this invention.

The control system for implementing Equation (8) is shown in FIG. 2. The operation of this system during an engagement is initiated when the pilot selects an appropriate value for the required ballistic pattern size at the target by adjusting a potentiometer or a continuous digital switch and activating the dispersion control system via a switch. These controls are located on the pilot's control panel 10. The command signal generator 12 then uses the resultant electrical signals to determine the initial setting of the dispersion mechanism, which may be of the type shown in U.S. Pat. No. 3,897,714, by $$\sigma_m = \left(1000\frac{r_B}{R}\right)\left(\frac{V_m + V_a}{V_m}\right) \quad (9)$$

where $\sigma_m$=angular ballistic dispersion in mils as measured at the gun and $r_B$=desired projectile pattern radius in feet defined by $$r_B = \frac{K\sigma_{BO}R}{1000}.$$

The first bracketed term of Equation (9) provides the mechanism dispersion setting for the initial slant range R and zero aircraft velocity. The second bracketed term of Equation (9) provides a means for increasing $\sigma_m$ to compensate for ballistic pattern contraction at a specified aircraft velocity.

The aircraft velocity is obtained from on-board sensors 14 appropriate to the aircraft type. $V_m$ is stored within the computational circuitry of the command signal generator 12 and R is obtained either directly from a tracking radar, laser rangefinder, etc., or indirectly by computations within the computational circuitry.

The initial dispersion mechanism setting is then changed as aircraft and target close range so that $$\sigma_m(t) = \left(1000\frac{r_B}{R}\right)\left(\frac{V_m + V_a}{V_m}\right)\left(\frac{R}{R(t)}\right) \quad (10)$$

where R(t) is the current slant range. R(t) can be obtained directly from a tracking radar, laser rangefinder, etc., or calculated according to $$R(t) = R - \int_O^t V_a(t)dt$$

which for a constant aircraft velocity is simply $$R(t)=R-V_at.$$

The command signal generator 12 translates $\sigma_m$ into a voltage signal that, when applied to the servo amplifier 16, results in a correct gun mechanism position. This is accomplished by computation circuitry that contains the nominal calibration curve obtained from firing tests of the type of mechanism and gun installed on the aircraft.

The servo amplifier 16, as shown in FIG. 2, receives the resultant command signal from the command signal generator 12 and a mechanism position signal from the mechanical dispersion device position transducer 18. The servo amplifier in response to these signals controls the application of power to the mechanism motor 20. This motor may either be electrical, pneumatic, or hydraulic, the selection of which is purely a function of available power.

The details of the embodiment of the control system broadly described in FIG. 2 are a function of the sensors available on-board the aircraft. The block diagram shown in FIG. 3 utilizes the pilot's estimate of range and the indicated air speed to determine present slant range to the target.

Figure 3:
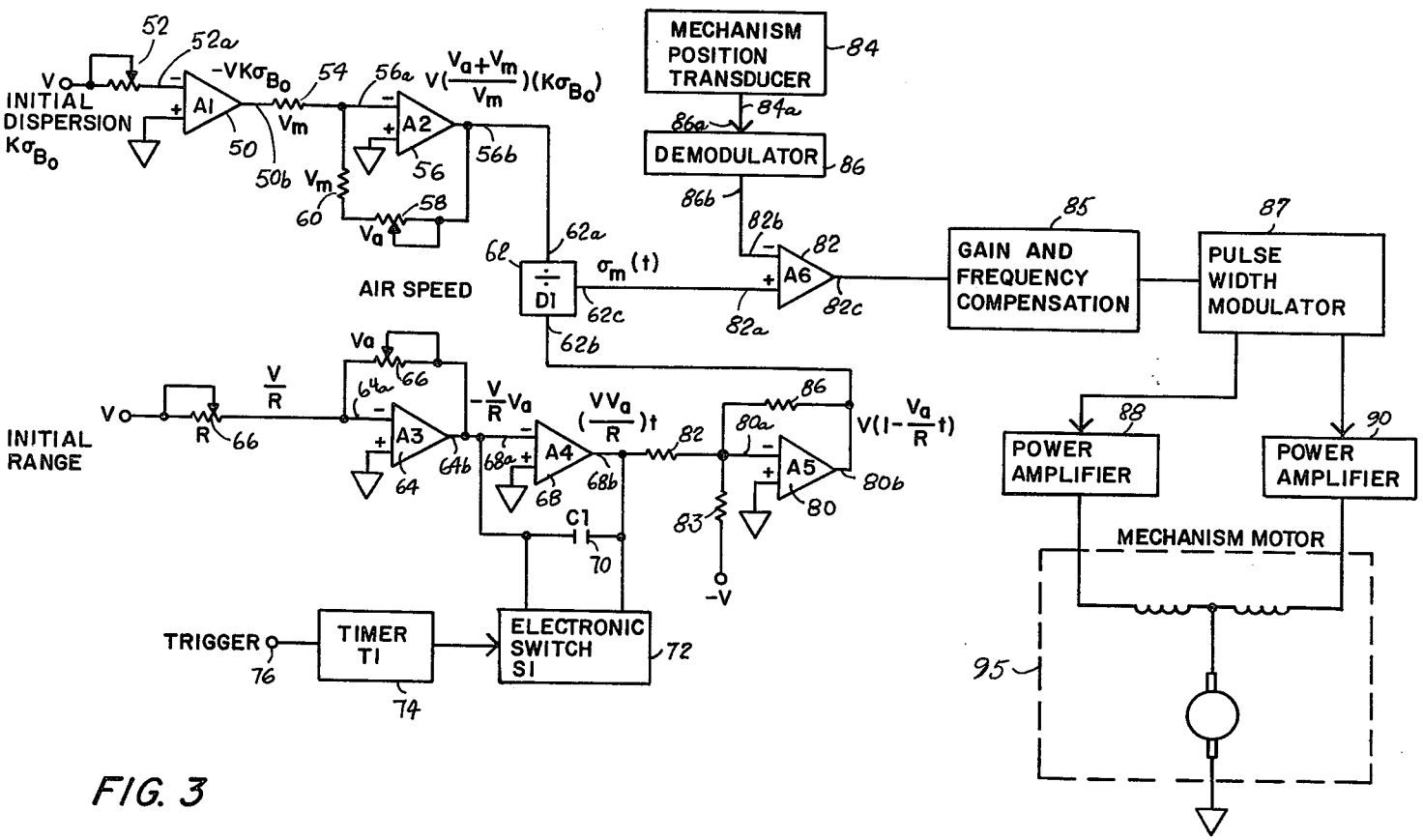
FIG. 3 is a block diagram of the system of FIG. 2 utilized when the pilot's estimated range and indicated air speed are used to determine current slant range.

In FIG. 3, a first amplifier 50 has its input terminal 50*a* coupled to a first source of reference voltage V via a variable resistor 52 which is set by the gunner to a resistance which provides a voltage which is a function of the desired initial dispersion, i.e., dispersion of projectiles at commencement of firing, ($K\sigma_{BO}$). The output terminal 50*b* of the first amplifier 50 provides an output signal of $-VK\sigma_{BO}$ and is coupled via a resistor 54 to the input terminal 56*a* of a second amplifier 56, whose output terminal 56*b* is coupled, via a feedback loop including a variable resistor 58 and a resistor 60, to its input terminal 56*a*. The resistances of the resistors 54 and 60 are each selected to provide a respective voltage drop which is a function of the muzzle velocity of the gun $V_m$. The variable resistor 58 is set by the gunner to a resistance which provides a voltage drop and is a function of the indicated air speed of the aircraft $V_a$. The output terminal 56*b* provides an output signal of $$v\left(\frac{V_a + V_m}{V_m}\right) K\sigma_{BO}$$

to the dividend input 62*a* of a divider circuit 62.

A third amplifier 64 has its input terminal 64*a* coupled to a second source of reference voltage V via a variable resistor 66 which is set by the gunner to a resistance which provides a voltage V/R which is a function of the initial range, i.e., the range at which it is desired to commence firing. The output terminal 64*b* is coupled, via a feedback loop including a variable resistor 66, to its input terminal 64*a*. The variable resistor 66 is set by the gunner to a resistance which also provides a voltage drop $V_a$ and is a function of the indicated air speed of the aircraft. The output terminal 64*b* provides an output signal of $-VV_a/R$ to the input terminal 68*a* of a fourth amplifier 68, whose output terminal 68*b* is coupled, via a feedback loop including a capacitor 70, to its input terminal 68*a*. The capacitor is normally shunted by an electronic switch 72, which is opened by a timer 74 for a predetermined interval of time, by a trigger signal from a source 76 controlled by the gun and provided at time t=0 to functionally connect the capacitor into the feedback loop, at which time the output terminal 68*b* provides an output signal of $VV_at/R$.

A fifth amplifier 80 has its input terminal 80*a* coupled via a resistor 82 to the output terminal 68*b*, via a resistor 83 to a source of reference voltage −V, and via a resistor 86 to its output terminal 80*b*. The output terminal 80*b* is coupled to the divisor input 62*b* of the divider circuit 62. The output signal $VV_at/R$ of the fourth amplifier 68 is summed with the reference voltage −V by the fifth amplifier to provide an output signal of $V(1-V_at/R)$.

The output terminal 62*c* of the divider circuit provides an output signal of $$D1(t) = (K\sigma_{BO}V)\left(\frac{V_a + V_m}{V_m}\right)\left(\frac{1}{V(1 - V_at/R)}\right)$$

Multiplying the third bracketed term by R in both numerator and denominator and noting that the V's in the first and third bracketed terms cancel each other, the output signal of the divider is $$D1(t) = (K\sigma_{BO})\left(\frac{V_a + V_m}{V_m}\right)\left(\frac{R}{R - V_at}\right).$$

Since $K\sigma_{BO}$ is $1000r_B/R$ from the previous definition of $r_B$, it is seen that the output signal of the divider is the desired ballistic dispersion $\sigma_m(t)$.

Figure 5:
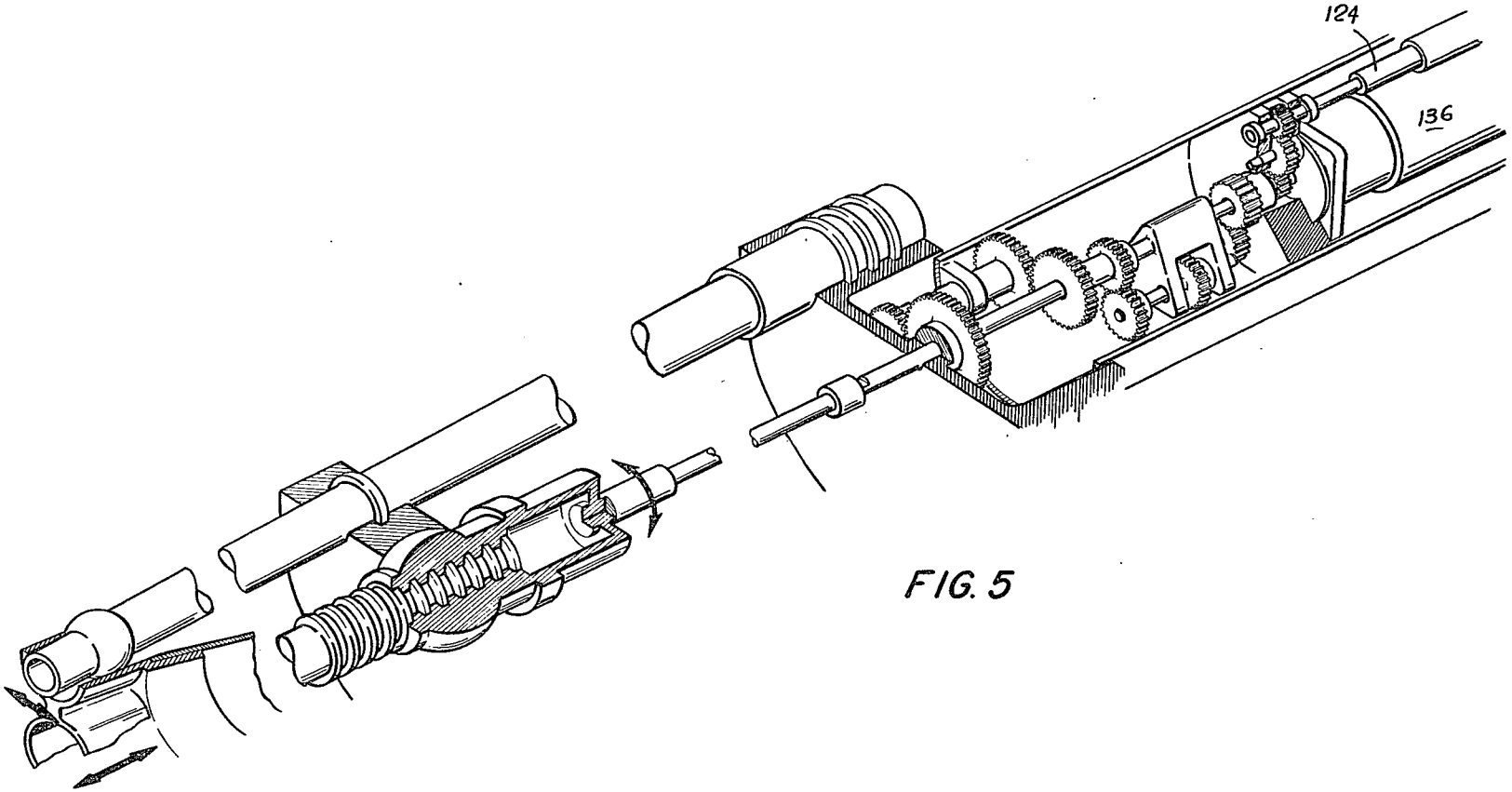
FIG. 5 is an illustration of the mechanism employed to change ballistic dispersion.

The output terminal 62c of the divider is coupled to one input terminal 82a of a sixth amplifier 82 which serves as the servo input amplifier. A mechanical position tranducer 84 is coupled to the mechanism of the gun, shown in FIG. 5, which varies the displacement of the gun barrels. An exemplary transducer includes two coils, and a core whose linear displacement with respect to, and, thereby, electromagnetic coupling of, the two coils is a function of the displacement of the gun barrels. The output terminal 84a of the transducer provides an amplitude modulated signal to the input terminal 86a of a demodulator 86 whose output terminal 86b is coupled to another input terminal 82b of the servo input amplifier 82. The output terminal 82c of the amplifier 82 is an error signal which is provided to a gain and frequency compensation circuit 85, thence to a pulse width modulator 87, and finally to a pair of servo power amplifiers 88 and 90 which drive a servo motor 95, which in turn drives the mechanism which varies the displacement of the gun barrels. The sign of the output signal at the servo input amplifier output terminal 82c determines whether the dispersion is to be increased or decreased, and, therefore, which of the power amplifiers is to be energized.

The timer 74 will reset the system by shunting the capacitor 70 at the end of the predetermined interval of time, e.g., 30 seconds, at which the system will return to the initial dispersion set by the gunner. The gunner can also operate a switch to disable the electronic switch 72 so that the system maintains the dispersion initially set by the gunner.

Figure 4:
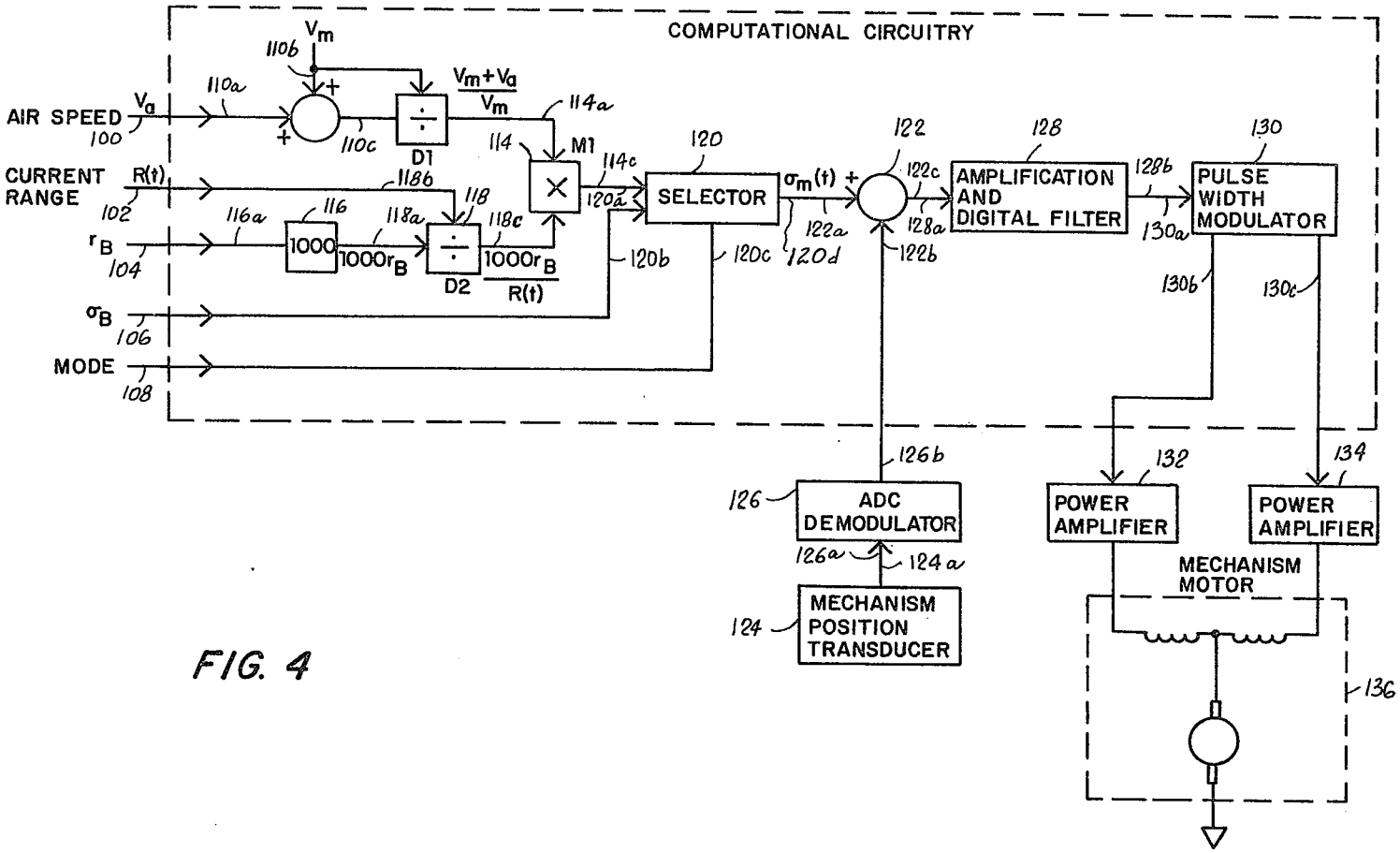
FIG. 4 is a block diagram of the system of FIG. 2 utilized when on-board sensors are utilized to determine aircraft speed and current slant range.

The block diagram shown in FIG. 4 utilizes sensors, not shown, to provide an 8 bit binary signal responsive to air speed $V_a$ on an input terminal 100, and an 8 bit binary signal responsive to slant range to target R(t) on an input terminal 102. The gunner sets in an 8 bit binary signal responsive to the desired initial radius of dispersion $r_B$ on an input terminal 104 and/or an 8 bit binary signal responsive to a desired fixed ballistic dispersion in mils on an input terminal 106, and a one bit binary signal responsive to line selection of either a variable or fixed dispersion on an input terminal 108. The input terminal 102 is coupled to a first input terminal 110a of a summing circuit 110, which has a second input terminal 110b which receives an 8 bit binary signal which is a function of the projectile muzzle velocity $V_m$. The output terminal 110c is coupled to and provides a signal $V_m+V_a$ to the first input terminal 112a of a dividing circuit 112. The input terminal 110b is also coupled to and provides the signal $V_m$ to the second input terminal 112b of the dividing circuit 112 so that its output terminal 112c provides the signal $(V_m+V_a)/V_m$ to a first input terminal 114a of a multiplying circuit 114.

The input terminal 104 is coupled to an input terminal 116a of a multiply by 1000 circuit whose output terminal 116b is coupled to and provides a signal $1000r_B$ to the first input terminal 118a of a dividing circuit 118. The input terminal is coupled to the second input terminal 118b so that the output terminal 118c provides the signal $1000r_B/R(t)$ to the second input terminal of the multiplying circuit 114. The output terminal 114c provides the signal $(V_m+V_a)/V_m \times 1000r_B/R(t)=\sigma_m(t)$ to the first input terminal 120a of a channel selector 120. The input terminal 106 is coupled to the second input terminal 120b of the selector, and the selection of channel is controlled by the signal on the input terminal 108 which is coupled to the input terminal 120c. The output terminal 120d provides either the signal $\sigma_m(t)$ or the signal $\sigma_B$ to the input terminal 122a of a summing circuit 122. A mechanical position transducer 124, like that shown in FIG. 3, is coupled to the mechanism of the gun, shown in FIG. 5, which varies the displacement of the gun barrels. The output terminal 124a of the transducer provides an amplitude modulated signal to the input terminal 126a of a demodulator analog to digital converter 126 whose output terminal 126b provides an 8 bit binary error signal to the second input terminal 122b of the summing circuit. The output terminal 122c is coupled to the input terminal 128a of an amplifier and digital filter circuit 128 whose output terminal 128b is coupled to the input terminal 130a of a pulse width modulator 130 whose two output terminals 130b and 130c are respectively coupled to a pair of servo power amplifiers 132 and 134, which drive a servo motor 136, which in turn drives the mechanism which varies the displacement of the gun barrels.

If the gunner has selected a constant dispersion pattern on the target mode at the input terminal 108, the system will process the signal $\sigma_m(t)$ on the 120a channel. If the constant angular ballistic dispersion mode has been selected at the input terminal 108, the system will process the signal $\sigma_B$ on the 120b channel. If desired, a timed reset function, as provided by the timer 74 in FIG. 3, can also be provided.

We claim:

1. In a weapon system for aiming and for firing a plurality of projectiles at a target by means of a fixed forward-firing Gatling type gun with a barrel cluster having a mean boresight and wherein said weapon system at any given time has an aiming error and a bias which is either constant or range dependent or both, and wherein each projectile as fired has a ballistic dispersion:

first means coupled to said barrel cluster for concurrently adjusting the alignment, or boresight, of one or more of the barrels of said barrel cluster with respect to said mean boresight of said barrel cluster before or during the firing interval whereby to vary the dispersion of said plurality of projectiles fired by said gun;

the improvement of:

second means coupled to said first means for causing said first means to continually adjust said alignment of said barrels of said barrel cluster with respect to said mean boresight to provide a predetermined and constant dispersion pattern of projectiles at the target as the error between the point of aim and the target and the range between the gun and the target continually vary.

2. In a weapon system according to claim 1, the improvement wherein:

said second means includes means to determine the instantaneous slant range and controls said first means to adjust said gun barrels so that the angular ballistic dispersion of the projectiles at said gun during any instant during firing are inversely proportional to the slant range between said gun and the target at that instant.

3. In a weapon system according to claim 2, the improvement wherein:

the angular ballistic dispersion for the $i^{th}$ projectile during a firing burst is:

$$\sigma_{Bi} = K\sigma_{BO}\left(\frac{R}{R - V_a[n + (i-1)Y]}\right)$$

where

K is a constant such that $0 < K \leqq 3$ for specifying the ballistic pattern at the target for affecting target damage;

$B_O$ is the aeroballistically corrected inherent or initial specified angular ballistic dispersion in mils for the slant range at which tracking is initiated;

R is the slant range in feet at which tracking is initiated;

$V_a$ is the velocity of the weapon system in feet per second;

n is the time interval between initiation of the angular dispersion growth and the firing of the first projectile in the burst; and Y is the reciprocal of the gun cyclic rate of fire in shots per second.

4. In a weapon system according to claim 1, the improvement wherein:

said second means causes said first means to adjust said barrels whereby the ballistic pattern of the projectiles as measured at a target in a plane normal to the mean trajectory of said projectiles is kept constant in both size and density during the entire engagement of said gun with the target.

5. In a weapon system according to claim 1, the improvement wherein:

said second means provides a drive signal to said first means which is a function of:

the instantaneous slant range to the target, the average muzzle velocity of the projectiles, and the desired dispersion pattern on the target, whereby, over a period of time, as the instantaneous slant range and the instantaneous muzzle velocity of the projectile, which includes the velocity of the weapon system, may vary, the dispersion pattern on the target remains constant.

* * * * *

UNITED STATES PATENT AND TRADEMARK OFFICE

CERTIFICATE OF CORRECTION

PATENT NO. : 4,244,272

DATED : January 13, 1981

INVENTOR(S) : Edgar R. Terry, Joseph A. Hudock

It is certified that error appears in the above-identified patent and that said Letters Patent are hereby corrected as shown below:

Column 5, line 52, change "$(R - V_a t)3$" to --$(R - V_a t)4$--.

Column 6, line 49, change "$\tau$" to --T--;
line 49, change "riciprocal" to --reciprocal--.

Signed and Sealed this

*Twenty-third* Day of *June 1981*

[SEAL]

*Attest:*

RENE D. TEGTMEYER

*Attesting Officer*

*Acting Commissioner of Patents and Trademarks*